US006375791B1

(12) United States Patent
Chiesl, III et al.

(10) Patent No.: US 6,375,791 B1
(45) Date of Patent: Apr. 23, 2002

(54) METHOD AND APPARATUS FOR DETECTING PRESENCE OF RESIDUAL POLISHING SLURRY SUBSEQUENT TO POLISHING OF A SEMICONDUCTOR WAFER

(75) Inventors: Newell E. Chiesl, III; Gregory L. Burns, both of Colorado Springs; Theodore C. Moore, Woodland Park, all of CO (US)

(73) Assignee: LSI Logic Corporation, Milpitas, CA (US)

( * ) Notice: Subject to any disclaimer, the term of this patent is extended or adjusted under 35 U.S.C. 154(b) by 0 days.

(21) Appl. No.: 09/467,622

(22) Filed: Dec. 20, 1999

(51) Int. Cl.[7] ..... B24B 29/02

(52) U.S. Cl. ..... 156/345; 451/56; 451/66; 216/84; 51/306

(58) Field of Search ..... 156/345; 451/66, 451/56, 39, 259, 282; 51/306; 216/84, 88, 89, 90, 93, 95

(56) References Cited

U.S. PATENT DOCUMENTS

| | | | | | |
|---|---|---|---|---|---|
| 5,265,378 | A | | 11/1993 | Rostoker | |
| 5,389,194 | A | | 2/1995 | Rostoker et al. | |
| 5,483,568 | A | | 1/1996 | Yano et al. | |
| 5,637,185 | A | | 6/1997 | Murarka et al. | |
| 5,656,097 | A | * | 8/1997 | Olesen et al. | 134/1 |
| 5,668,063 | A | | 9/1997 | Fry et al. | |
| 5,704,987 | A | * | 1/1998 | Huynh et al. | 134/6 |
| 5,755,614 | A | | 5/1998 | Adams et al. | |
| 5,861,055 | A | | 1/1999 | Allman et al. | |
| 5,948,697 | A | | 9/1999 | Hata | |
| 5,993,298 | A | * | 11/1999 | Duescher | 451/56 |
| 6,012,966 | A | * | 1/2000 | Ban et al. | 451/8 |
| 6,108,093 | A | * | 8/2000 | Berman | 356/394 |
| 6,140,130 | A | * | 10/2000 | Salmen et al. | 436/55 |
| 6,165,050 | A | * | 12/2000 | Ban et al. | 451/8 |
| 6,220,934 | B1 | * | 4/2001 | Sharples et al. | 451/36 |

* cited by examiner

*Primary Examiner*—Gregory Mills
*Assistant Examiner*—Sylvia R. MacArthur
(74) *Attorney, Agent, or Firm*—Maginot, Addison & Moore

(57) ABSTRACT

A method of detecting presence of a polishing slurry on a semiconductor wafer subsequent to polishing of the wafer includes the step of adding a chemical marker to the polishing slurry. The method also includes the step of polishing a first side of the wafer in order to remove material from the wafer. In addition, the method includes the step of applying the polishing slurry to the first side of the wafer during the polishing step. Moreover, the method includes the step of ceasing the polishing step when the wafer has been polished to a predetermined level. Yet further, the method includes the step of directing incident electromagnetic radiation onto the wafer subsequent to the ceasing step. The method also includes the step of detecting a physical characteristic of resultant electromagnetic radiation which is produced in response to the incident electromagnetic radiation being directed onto the wafer. Moreover, the method includes the step of determining presence of the chemical marker so as to determine presence of the polishing slurry on the wafer based on the physical characteristic of the resultant electromagnetic radiation. A polishing system for polishing a semiconductor wafer is also disclosed.

3 Claims, 2 Drawing Sheets

METHOD AND APPARATUS FOR DETECTING PRESENCE OF RESIDUAL POLISHING SLURRY SUBSEQUENT TO POLISHING OF A SEMICONDUCTOR WAFER

TECHNICAL FIELD OF THE INVENTION

The present invention relates generally to a method of fabricating a semiconductor wafer, and more particularly to a method and apparatus for detecting presence of residual polishing slurry subsequent to polishing of a semiconductor wafer.

BACKGROUND OF THE INVENTION

Semiconductor integrated circuits are typically fabricated by a layering process in which several layers of material are fabricated on a surface of a wafer. This fabrication process typically requires subsequent layers to be fabricated upon a smooth, planar surface of a previous layer. However, the surface topography of layers may be uneven due to an uneven topography associated with an underlying layer. As a result, a layer may need to be polished in order to present a smooth, planar surface to a subsequent processing step. For example, an insulator layer may need to be polished prior to formation of a conductor layer or pattern on an outer surface thereof.

In general, a semiconductor wafer may be polished to remove high topography and surface defects such as scratches, roughness, or embedded particles of dirt or dust. The polishing process typically is accomplished with a polishing system that includes top and bottom platens (e.g. a polishing table and a wafer carrier or holder), between which the semiconductor wafer is positioned. The platens are moved relative to each other thereby causing material to be removed from the surface of the wafer. This polishing process is often referred to as mechanical planarization (MP) and is utilized to improve the quality and reliability of semiconductor devices.

The polishing process may also involve the introduction of a chemical polishing slurry to facilitate higher removal rates, along with the selective removal of materials fabricated on the semiconductor wafer. This polishing process is often referred to as chemical-mechanical planarization or chemical-mechanical polishing (CMP). The chemical polishing slurry is generally an aqueous acidic or basic solution having a number of abrasive particles, such as silica ($SiO_2$), alumina ($Al_2O_3$), or ceria ($Ce_2O_3$) particles, suspended therein. One common silicon polishing slurry includes silica particles in a colloidal suspension. The proportion of particles in such an exemplary slurry is typically from 1–15% by weight, with the pH of the slurry typically being from 8.0–11.5 (as controlled by the addition of an alkali such as NaOH, KOH, or $NH_4OH$). Other slurries are also commonly utilized to polish other wafer materials such as metals.

While the use of a chemical slurry provides numerous advantages, certain concerns arise from the use thereof. For example, as described above, the chemical slurry includes, amongst other things, abrasive particles. Such abrasive particles must be completely removed from the wafer prior to subsequent processing thereof. In particular, if any particles remain on the wafer after a post-polishing rinse and/or cleaning process, such particles may create defects during subsequent fabrication processes thereby lowering manufacturing yields which undesirably increases costs of the integrated circuit.

Moreover, it is desirable to completely remove the abrasive particles associated with the slurry from the work tools associated with the fabrication process. For example, if slurry particles become embedded in the polishing pad associated with the polishing table, polishing efficiency may be adversely effected thereby undesirably increasing costs associated with manufacture of the integrated circuit devices.

It should be appreciated that it is generally difficult to detect presence of residual particles from the chemical polishing slurry. In particular, the abrasive particles utilized in typical chemical polishing slurries are generally between 20–200 nanometers in diameter. Presence of such small particles is generally extremely difficult to do without use of sophisticated, expensive laboratory equipment such as a scanning electron microscope (SEM). It should be appreciated that use of such laboratory equipment is impractical for use in a manufacturing process due to the amount of time necessary to test a single specimen.

Thus, a continuing need exists for a method which accurately and efficiently detects presence of residual chemical slurry subsequent to a chemical-mechanical polishing process. Moreover, a continuing need exists for a method which accurately and efficiently detects presence of residual chemical slurry subsequent to a chemical-mechanical polishing process which can be quickly and easily incorporated into a manufacturing process.

SUMMARY OF THE INVENTION

In accordance with one embodiment of the present invention, there is provided a method of detecting presence of a polishing slurry subsequent to polishing of a semiconductor wafer. The method includes the step of adding a chemical marker to the polishing slurry. The method also includes the step of polishing a first side of the wafer in order to remove material from the wafer. The method further includes the step of applying the polishing slurry to the first side of the wafer during the polishing step. Moreover, the method includes the step of ceasing the polishing step when the wafer has been polished to a predetermined level. Yet further, the method includes the step of detecting presence of the chemical marker so as to determine presence of the polishing slurry subsequent to the ceasing step.

Pursuant to another embodiment of the present invention, there is provided a method of detecting presence of a polishing slurry on a semiconductor wafer subsequent to polishing of the wafer. The method includes the step of adding a chemical marker to the polishing slurry. The method also includes the step of polishing a first side of the wafer in order to remove material from the wafer. In addition, the method includes the step of applying the polishing slurry to the first side of the wafer during the polishing step. Moreover, the method includes the step of ceasing the polishing step when the wafer has been polished to a predetermined level. Yet further, the method includes the step of directing incident electromagnetic radiation onto the wafer subsequent to the ceasing step. The method also includes the step of detecting a physical characteristic of resultant electromagnetic radiation which is produced in response to the incident electromagnetic radiation being directed onto the wafer. Moreover, the method includes the step of determining presence of the chemical marker so as to determine presence of the polishing slurry on the wafer based on the physical characteristic of the resultant electromagnetic radiation.

Pursuant to yet another embodiment of the present invention, there is provided a method of detecting presence of a polishing slurry on a work tool subsequent to polishing of a semiconductor wafer. The method includes the step of adding a chemical marker to the polishing slurry. The method also includes the step of polishing a first side of the wafer with the work tool in order to remove material from the wafer. The method further includes the step of applying the polishing slurry to the first side of the wafer during the polishing step. Moreover, the method includes the step of ceasing the polishing step when the wafer has been polished to a predetermined level. In addition, the method includes the step of directing incident electromagnetic radiation onto the work tool subsequent to the ceasing step. Yet further, the method includes the step of detecting a physical characteristic of resultant electromagnetic radiation which is produced in response to the incident electromagnetic radiation being directed onto the work tool. Moreover, the method includes the step of determining presence of the chemical marker so as to determine presence of the polishing slurry on the work tool based on the physical characteristic of the resultant electromagnetic radiation.

Pursuant to yet a further embodiment of the present invention, there is provided a polishing system for polishing a semiconductor wafer. The polishing system includes a polishing station which is operable to remove material from the wafer. The polishing station has a polishing surface which contacts a first surface of the semiconductor wafer so as to remove the material therefrom. The polishing system also includes a slurry distribution assembly for advancing a polishing slurry onto the polishing surface. The polishing slurry has a chemical marker present therein. The polishing system further includes a rinse station which is operable to direct a flow of fluid onto the wafer subsequent to polishing by the polishing station. Moreover, the polishing system includes a slurry detection station which is operable to detect presence of the chemical marker so as to determine presence of the polishing slurry on the wafer after the flow of fluid has been directed onto the wafer by the rinse station.

It is an object of the present invention to provide a new and useful method and apparatus for detecting presence of residual polishing slurry subsequent to a chemical-mechanical polishing process.

It is also an object of the present invention to provide an improved method and apparatus for detecting presence of residual polishing slurry subsequent to a chemical-mechanical polishing process.

It is a further object of the present invention to provide a method and apparatus for detecting presence of residual polishing slurry on a semiconductor wafer subsequent to a chemical-mechanical polishing process.

It is yet further an object of the present invention to provide a method and apparatus for detecting presence of residual polishing slurry on a work tool subsequent to a chemical-mechanical polishing process.

It is also an object of the present invention to provide a method and apparatus for detecting presence of residual polishing slurry subsequent to a chemical-mechanical polishing process which can be quickly and easily integrated into a manufacturing process without the need for expensive laboratory equipment.

The above and other objects, features, and advantages of the present invention will become apparent from the following description and the attached drawings.

DETAILED DESCRIPTION OF A PREFERRED EMBODIMENT

Figure 1A:
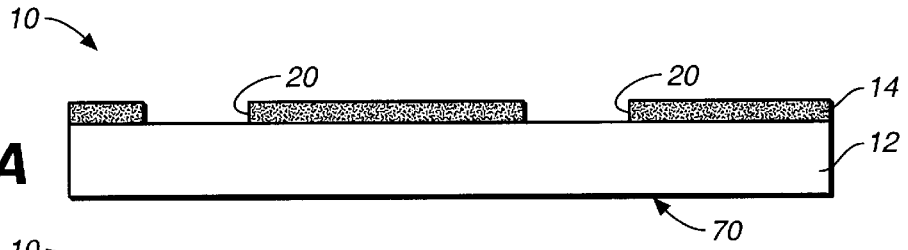
FIGS. 1A–1F show sectional views of a semiconductor wafer during various steps of a fabrication process.
Figure 1B:
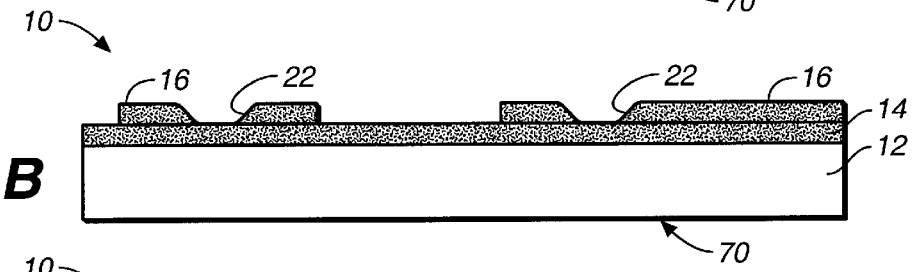

While the invention is susceptible to various modifications and alternative forms, a specific embodiment thereof has been shown by way of example in the drawings and will herein be described in detail. It should be understood, however, that there is no intent to limit the invention to the particular form disclosed, but on the contrary, the intention is to cover all modifications, equivalents, and alternatives falling within the spirit and scope of the invention as defined by the appended claims.

Referring now to FIGS. 1A–1F, there is shown a semiconductor wafer 10 after various steps of a fabrication process of the present invention. The semiconductor wafer 10 includes a semiconductor substrate 12, such as silicon. A first insulating layer 14 and a first metal layer 16 are deposited or otherwise disposed on the semiconductor substrate 12. In particular, the fabrication process deposits the first insulating layer 14 on the semiconductor substrate 12 such that a contact hole 20 is formed in the first insulating layer 14 at a location above a transistor portion of the semiconductor substrate 12. Moreover, the fabrication process patterns the first metal layer 16 (e.g. aluminum) over the first insulating layer 14 and the contact hole 20. As a result, the first metal layer 16 fills the contact hole 20 forming an electrical contact with the transistor portion of the semiconductor substrate 12. Moreover, the filling of the contact hole 20 forms a pit 22 in the portion of the first metal layer 16 disposed above the contact hole 20.

Figure 1C:
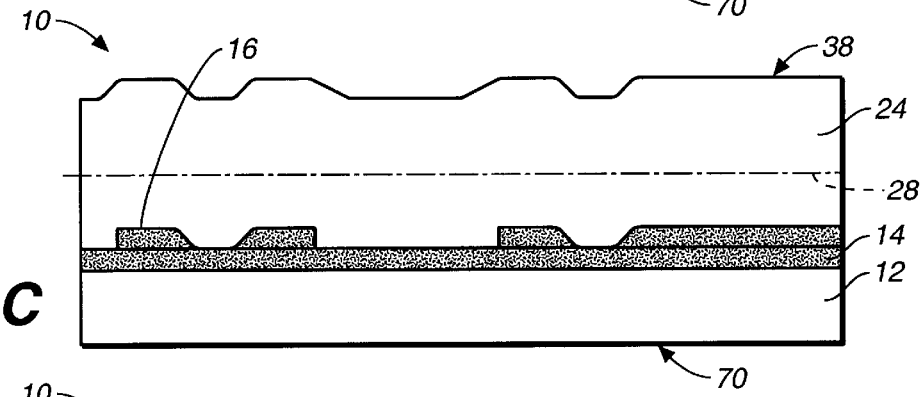
Figure 1D:
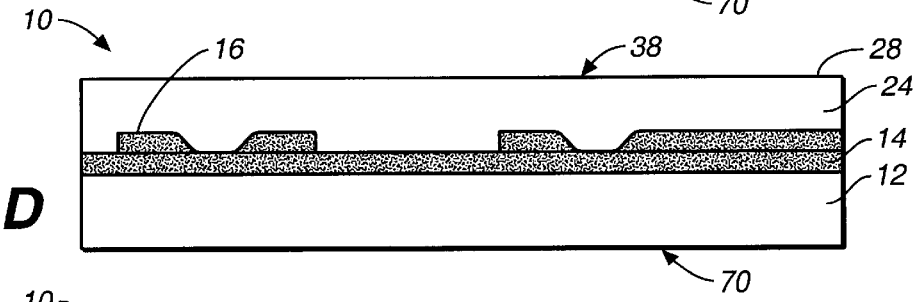

As shown in FIG. 1C, a second insulating layer 24 is deposited on the outer surface of the first insulating layer 14 and the first metal layer 16. The second insulating layer 24 has an uneven surface topography as a result of the varying topography associated with the first insulating layer 14 and a first metal layer 16. The uneven surface topography of the second insulating layer 24 may cause accuracy problems in fabricating additional layers associated with the semiconductor wafer 10. For example, the uneven surface topography may cause accuracy problems for a lithography process which is utilized to pattern a second metal layer 26 (FIG. 1F) on the second insulating layer 24. As shall be discussed below in more detail, in order to avoid such accuracy problems associated with the uneven topography of the second insulating layer 24, a polishing system, such as a polishing system 30 of FIG. 2, polishes the second insulating layer 24 down to a desired level 28 thereby planarizing the surface of the second insulating layer 24 (see FIG. 1D).

Figure 1E:
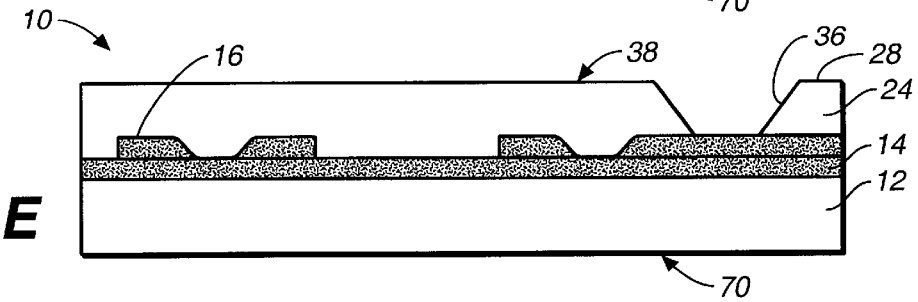
Figure 1F:
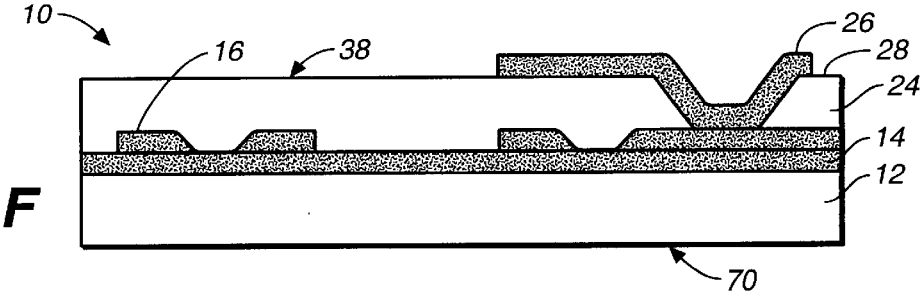

As alluded to above, once the semiconductor wafer 10 has been polished such that a planar surface is created, additional layers may be deposited or otherwise fabricated thereon. For example, as shown in FIGS. 1E and 1F, a via hole 36 may be etched through the second insulating layer 24. Thereafter, the second metal layer 26 may be deposited on the second insulating layer 24. It should be appreciated that numerous additional layers may be deposited on the semiconductor wafer 10 in the manner previously described.

Figure 2:
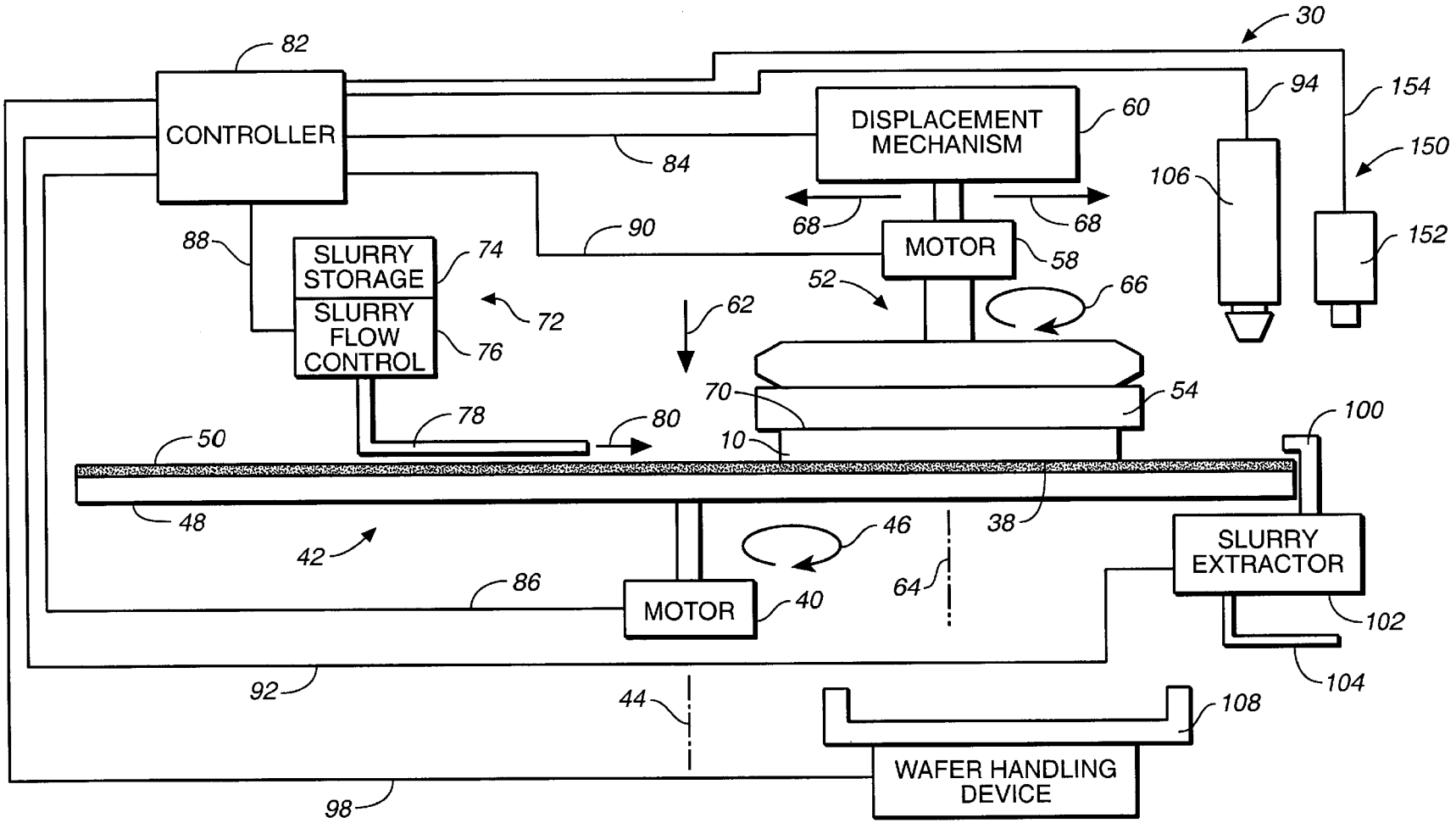
FIG. 2 shows an embodiment of a polishing system which incorporates various features of the present invention therein.

Referring now to FIG. 2, there is shown a preferred embodiment of the polishing system 30 which is used to planarize a front side or surface 38 of the semiconductor wafer 10. The polishing system 30 includes a platen motor or other drive mechanism 40 and a platen assembly 42. The platen motor 40 rotates the platen assembly 42 about a center axis 44. The platen motor 40 may rotate the platen assembly 42 in a clockwise direction (as shown by arrow 46 of FIG. 2) or in the counterclockwise direction.

The platen assembly 42 includes a polishing platen 48 and a polishing pad 50 mounted on the polishing platen 48. Both the polishing platen 48 and the polishing pad 50 are preferably circular and collectively define a polishing area or surface against which the front side 38 of the semiconductor wafer 10 may be polished. Moreover, the polishing pad 50 is typically made of blown polyurethane which protects the polishing platen 48 from chemical slurry and other chemicals introduced during the polishing process.

The polishing system 30 also includes a polishing head assembly 52. The polishing head assembly 52 includes a wafer carrier 54, a wafer carrier motor or other drive mechanism 58, and a wafer carrier displacement mechanism 60. The wafer carrier 54 applies a controlled, adjustable downward force (i.e. in the general direction of arrow 62) in order to press the front side 38 of the semiconductor wafer 10 into contact with the polishing pad 50 so as to facilitate polishing of the front side 38 of the semiconductor wafer 10.

The wafer carrier motor 58 rotates the wafer carrier 54 and the semiconductor wafer 10 about a center axis 64. The wafer carrier motor 58 may rotate the wafer carrier 54 in a clockwise direction (as shown by arrow 66 of FIG. 2) or in the counterclockwise direction. However, the wafer carrier motor 58 preferably rotates the wafer carrier 54 in the same rotational direction as the platen motor 40 rotates the platen assembly 42 (although the wafer carrier motor 58 may rotate the semiconductor wafer 10 in the rotational direction opposite the rotational direction of the platen assembly 42 as desired).

The wafer carrier 54 also includes mechanisms (not shown) for holding the semiconductor wafer 10. For example, the wafer carrier 54 may include a vacuum-type mechanism which generates a vacuum force that draws the semiconductor wafer 10 against the wafer carrier 54. Once the semiconductor wafer 10 is positioned on the wafer carrier 54 and held in contact with the platen assembly 42 for polishing, the vacuum force may be removed. In such an arrangement, the wafer carrier 54 may be designed with a friction surface or a carrier pad which engages a back side 70 of the semiconductor wafer 10. Such a carrier pad, along with the force being applied in the general direction of arrow 62, creates a frictional force between the wafer carrier 54 and the semiconductor wafer 10 that effectively holds the semiconductor wafer 10 against the wafer carrier 54 thereby causing the semiconductor wafer 10 to rotate at the same velocity as the wafer carrier 54. It should be appreciated that such wafer carriers and carrier pads are of conventional design and are commercially available.

The displacement mechanism 60 selectively moves the wafer carrier 54 and hence the semiconductor wafer 10 across the platen assembly 42 in the general direction of arrows 68. Such movement defines a polishing path which may be linear, sinusoidal, or a variety of other patterns. The wafer carrier displacement mechanism 60 is also capable of moving the semiconductor wafer 10 along a polishing path to a location beyond the edge of the polishing pad 50 so that the semiconductor wafer 10 "overhangs" the edge. Such an overhanging arrangement permits the semiconductor wafer 10 to be moved partially on and partially off the polishing pad 50 to compensate for polishing irregularities caused by a relative velocity differential between the faster moving outer portions and the slower moving inner portions of the platen assembly 42.

The polishing system 30 also includes a chemical slurry system 72. The slurry system 72 includes a slurry storage reservoir 74, a slurry flow control mechanism 76, and a slurry conduit 78. The slurry storage reservoir 74 includes one or more containers for storing chemical polishing slurry. In particular, the slurry storage reservoir 74 contains a chemical slurry such as an aqueous acidic or basic solution having a number of abrasive particles, such as silica ($SiO_2$), alumina ($Al_2O_3$), or ceria ($Ce_2O_3$) particles, suspended therein. As described in greater detail below, the chemical polishing slurry of the present invention also includes a chemical marker which facilitates identification of any residual slurry which may be present on the semiconductor wafer 10 or a work tool such as the components associated with the polishing system 30 (e.g. the polishing pad 50) subsequent to the polishing process.

The slurry flow control mechanism 76 controls the flow of slurry from the slurry storage 74, through the slurry conduit 78, and onto the polishing area atop the platen assembly 42. Hence, the slurry flow control mechanism 76 selectively introduces a flow of chemical polishing slurry onto the polishing pad 50 via the slurry conduit 78 (as indicated by arrow 80).

The polishing system 30 also includes extraction conduit 100, an extraction flow control mechanism 102, and a waste conduit 104. The extraction conduit 100 receives effluent from the polishing area associated with the platen assembly 42. The effluent may include the chemical polishing slurry from the slurry supply system 72 along with materials removed from the semiconductor wafer 10. The extraction flow control mechanism 102 controls the flow of effluent from the extraction conduit 100 to waste conduit 104. The waste conduit 104 of the polishing system 30 is fluidly coupled to a waste treatment facility (not shown) in order to chemically treat or otherwise properly dispose of the effluent subsequent to extraction thereof.

The polishing system 30 also includes a rinse mechanism 106 and a wafer handling mechanism 108. The rinse mechanism 106 rinses the semiconductor 10 subsequent to polishing thereof in order to clean or otherwise remove any residual debris such as polished wafer material or slurry abrasive particles from the wafer 10 prior to subsequent processing. It should be appreciated that the rinse mechanism 106 may rinse the wafer 10 with water or may also rinse the wafer 10 with a solution such as a hydrochloric acid (HCl) solution.

The wafer handling mechanism 108 is configured to load and unload wafers 10 on and off, respectively, of the polishing system 30. In particular, the wafer handling mechanism 108 is configured to present a wafer 10 to the wafer carrier 54 in order for the carrier 54 to engage the back side 70 of the wafer 10 so as to commence a polishing procedure. The wafer handling mechanism 108 is also configured to remove a polished wafer 10 from the wafer carrier 54 once the wafer 10 has been rinsed by the rinse mechanism 106. It should be appreciated that the polishing system 30 may be embodied with one or more discrete rinse mechanisms 106 which are spaced apart from the polishing platen assembly 42. In such an arrangement, the wafer handling mechanism 108 is configured to move the wafer 10 from the wafer carrier 54 to the additional rinse mechanism(s) such that the wafer 10 may be rinsed prior to subsequent processing thereof.

The polishing system 30 also includes a slurry detection system 150. The slurry detection system 150 includes a detector 152 which is configured to detect presence of residual chemical slurry on the wafer 10 subsequent to rinsing thereof. The detector 152 is configured to generate electromagnetic radiation (i.e. incident electromagnetic radiation) which is directed onto the wafer 10. The resultant electromagnetic radiation which is produced as a result of the incident electromagnetic radiation being directed onto the wafer 10 is collected by the detector 152 such that certain physical characteristics thereof may be determined. As shall be discussed below, physical characteristics of the resultant electromagnetic radiation may be analyzed in order to determine presence of residual chemical slurry on the wafer 10. The detector 152 may be configured to generate, receive, and analyze numerous types of electromagnetic radiation such as radiation having wavelengths within the x-ray, UV, visible, or infrared ranges.

The polishing system 30 also includes a controller 82 for controlling the polishing system 30 in order to effectuate the desired polishing results for the semiconductor wafer 10. In particular, the controller 82 is electrically coupled to the displacement mechanism 60 via a signal line 84 to monitor and controllably adjust the polishing path of the semiconductor wafer 10 and the speed at which the semiconductor wafer 10 is moved across the platen assembly 42.

Moreover, the controller 82 is electrically coupled to the platen motor 40 via a signal line 86 in order to monitor the output speed of the platen motor 40 and hence the rotational velocity of the platen assembly 42. The controller 82 adjusts the output speed of the platen motor 40 and hence the rotational velocity of the platen assembly 42 as required by predetermined operating parameters.

The controller 82 is electrically coupled to the slurry flow control mechanism 76 via a signal line 88 in order to monitor the flow rate of the chemical polishing slurry onto the polishing pad 50 of the platen assembly 42. The controller 82 adjusts the flow rate of the chemical slurry onto the polishing pad 50 of the platen assembly 42 as required by predetermined operating parameters.

The controller 82 is electrically coupled to the wafer carrier motor 58 via a signal line 90 in order to monitor the output speed of the wafer carrier motor 58 and hence the rotational velocity of the wafer carrier 54. The controller 82 adjusts the output speed of the wafer carrier motor 58 and hence the rotational velocity of the wafer carrier 54 as required by predetermined operating parameters.

The controller 82 is electrically coupled to the extraction flow control mechanism 102 via a signal line 92 in order to monitor the flow rate of the effluent from the polishing area of the platen assembly 42 to the waste conduit 104. The controller 82 adjusts the flow rate of the effluent from the polishing area of the platen assembly 42 as required by predetermined operating parameters.

The controller 82 is also electrically coupled to the rinse mechanism 106 via a signal line 94 in order to selectively rinse the wafer 10 subsequent to polishing thereof. Moreover, the controller 82 is also electrically coupled to the wafer handling mechanism 108 via a signal line 98 in order to selectively load and unload wafers into and out of the polishing system 30.

The controller 82 is also electrically coupled to the detector 152 of the slurry detection system 150 via a signal line 154. Hence, when the detector 152 detects presence of residual chemical slurry on the semiconductor wafer 10 subsequent to polishing thereof, the detector 152 generates an output signal on the signal line 154 indicative of the same.

As alluded to above, in order to facilitate detection of residual chemical slurry, a chemical marker is added to the chemical polishing slurry of the present invention prior to introduction of the slurry into the polishing system 30. What is meant herein by the term "chemical marker" is an additive which, when added to the chemical polishing slurry, chemically or physically modifies the surface or bulk of the abrasive particles suspended in the slurry so as to render the abrasive particles susceptible to identification when exposed to electromagnetic radiation of a predetermined wavelength. For example, the chemical marker may be in the form of a chemical compound which, when added to the chemical slurry, chemically or physically modifies the surface or bulk of the abrasive particles such that an applied light source reflects off, transmits through, causes fluorescence of, or is polarized by the altered particles. Moreover, the chemical marker may also be in the form of radiation which causes similar modification of the abrasive particles of the chemical polishing slurry. A specific example of one such chemical marker is the use of cerium ions ($Ce^{++}$) in a slurry containing silica abrasive particles. However, other chemical markers may also be utilized by one skilled in the art with only routine experimentation. For example, Fura-2 (i.e. 1-[2-(5-Carboxyoxazol-2-yl)-6-aminobenzofuran-5-oxy]-2-(2'-amino-5'-methylphenoxy)-ethane-N,N,N',N'-tetraacetic acid) may be utilized as a chemical marker in a chemical polishing slurry which has been doped with calcium ions ($Ca^{++}$). Indo-1 (i.e. $C_{31}H_{22}F_2K_5N_3O_{12}$) may also be utilized as a chemical marker in a chemical polishing slurry which has been doped with calcium ions.

Moreover, as used herein, "presence" of the chemical marker is "detected" or "determined" when either the chemical marker itself (i.e. the chemical additive that is added to the slurry) is detected or the result of such an additive is detected (i.e. the modified abrasive particles). Hence, as an example, "presence" of the chemical marker is "detected" or "determined" if presence of the chemical additive itself is detected. Additionally, "presence" of the chemical marker is "detected" or "determined" if the modified abrasive particles of the chemical slurry are detected.

Such modification of the abrasive particles allows for detection of presence of residual chemical polishing slurry on the semiconductor wafer 10 or on the components associated with the polishing system 30. For example, the abrasive particles of the chemical polishing slurry may be modified such that they reflect a specific wavelength of light when exposed to light in the UV or infrared light range with the intensity of the reflected light depending on the amount of chemical slurry which is present on the wafer 10 or on one of the components associated with the polishing system 30. As a further example, the abrasive particles of the chemical polishing slurry may be modified such that they reduce the amount of transmitted light which passes through the abrasive particles based on the amount of chemical slurry which is present on the wafer 10 or on one of the components associated with the polishing system 30. As yet another example, the abrasive particles of the chemical polishing slurry may be modified such that they show a change in polarity that is dependent on the amount of chemical slurry which is present on the wafer 10 or on one of the components associated with the polishing system 30. Yet further, the abrasive particles of the chemical polishing slurry may be modified such that they fluoresce a specific wavelength of light when exposed to light or other radiation with the intensity of the fluoresced light depending on the amount of chemical slurry which is present on the wafer 10 or on one of the components associated with the polishing system 30.

Hence, it should be appreciated that numerous process monitoring techniques may utilize the above-described marking of the chemical polishing slurry. Although, as described above, the abrasive particles may be modified in numerous different ways in order to be detected by use of certain types of light, for purposes of the following discussion, the case in which the abrasive particles of the chemical polishing slurry are modified such that they fluoresce a specific wavelength of light when exposed to light or other radiation (with the intensity of the fluoresced light depending on the amount of chemical slurry which is present on the wafer 10 or on one of the components associated with the polishing system 30) will be hereinafter utilized to demonstrate specific examples of application of the concepts of the present invention.

As a first example, the above-described techniques may be utilized to monitor the percent solids of the chemical polishing slurry in the slurry storage reservoir 74. In particular, the intensity level of the light fluoresced by the abrasive particles of the chemical polishing slurry stored in the slurry storage reservoir 74 may be utilized to calculate the percent solids of the chemical polishing slurry. In such a manner, the percent solids of the slurry may be adjusted in order to maintain the content of the slurry within predetermined operating parameters. Moreover, the presence of fluoresced light may be utilized to detect undesirable slurry build-up within the other components associated with the slurry supply system 72 such as the supply conduit 78.

Moreover, the above-described techniques may be utilized to monitor slurry buildup on other work tools or components associated with the polishing system 30 such as the polishing pad 50, the brushes (not shown), the conditioning wheels (not shown), the polishing head, the slurry lines, or even the scrubber tools (not shown). It should be appreciated that excessive slurry buildup on such components may undesirably change the effectiveness of the polishing system 30 by, for example, changing the polishing rate, cleaning rate, or conditioning rate of the system 30. Moreover, such a buildup may also undesirably reduce the final yield of the devices fabricated on the wafer 10 being polished by the polishing system 30.

In order to provide for such monitoring, an assembly including a radiation source such as a UV light or x-ray source and a corresponding detector may be utilized. The detector may be positioned to detect either reflected or transmitted radiation in order to determine the intensity thereof. For example, the detector may be positioned on the same side of the polishing pad 50 as the source in order to detect radiation which is reflected from the polishing pad 50. Alternatively, the detector may be positioned on the opposite side of the polishing pad 50 as the source in order to detect radiation which is transmitted through the polishing pad 50. As described above, the intensity of such radiation may be monitored in order to determine the amount of residual slurry on the polishing pad. Similar configurations may also be utilized to detect presence of residual chemical polishing slurry on the other components associated with the polishing system such as the brushes (not shown), conditioning wheels (not shown), or even the scrubber tools (not shown).

Moreover, as will now be discussed in particular regard to the detector 152 of the slurry detection system 150, the above-described techniques may be utilized to monitor for presence of residual chemical polishing slurry on the semiconductor wafer 10 itself. In particular, the detector 152 is operated to direct light onto the semiconductor wafer 10 once the wafer 10 has been rinsed by the rinse mechanism 106 subsequent to polishing of the wafer 10. This causes the modified abrasive particles within any residual chemical polishing slurry present on the wafer 10 to fluoresce light of a predetermined wavelength thereby indicating presence of the chemical marker and hence residual chemical polishing slurry. Such light is collected by the detector 152 in order for the intensity thereof to be determined. As described above, the intensity of the light fluoresced by the residual chemical polishing slurry is indicative of the amount of residual slurry which is present on the wafer 10. The detector 152 then generates output signals which are indicative of the amount of residual chemical polishing slurry present on the wafer 10. Such output signals are communicated to the to the controller 82 so that the wafer 10 may be identified (and potentially subjected to additional processing).

In operation, the polishing system 30 polishes the semiconductor wafer 10 in order to planarize the front side 38 thereof. In particular, the polishing system 30 removes material from the front side 38 of the semiconductor wafer 10 until the wafer 10 is polished down to the polishing endpoint layer 20. More specifically, the wafer carrier 54 engages the back side 70 of the semiconductor wafer 10 and presses the front side 38 of the semiconductor wafer 10 against the polishing pad 50. The controller 82 then causes the platen motor 40 to rotate the platen assembly 42 and the wafer carrier motor 58 to rotate the wafer carriers 54. The controller 82 may also begin to control the displacement mechanism 60 so as to move the wafer carrier 54 along a predetermined polishing path. The slurry flow control mechanism 76 is also controlled by the controller 82 in order to apply chemical polishing slurry (having the chemical marker previously added thereto) to the polishing pad 50 at a predetermined flow rate. The resulting complex movement of the wafer carrier 54 relative to the polishing pad 50, the force being applied to the semiconductor wafer 10 in the general direction of arrow 62 of FIG. 2, and the chemical polishing slurry all cooperate to selectively remove material from the front side 38 of the semiconductor wafer 10.

Once the semiconductor wafer 10 has been polished down to the endpoint layer 20, the controller 82 ceases polishing of the wafer 10. Thereafter, the controller 82 operates the rinse mechanism 106 in order to rinse or otherwise clean the semiconductor wafer 10. Once rinsed, the wafer is unloaded from the wafer carrier 54 by the wafer handling mechanism 108 so as to present the wafer 10 to subsequent fabrication processes.

Moreover, once the rinse mechanism 106 has rinsed the wafer 10, the detector 152 of the slurry detection system 150 is operated to determine if any residual amounts of chemical polishing slurry remain on the wafer 10. Such a determination may be made either before, after, or during unloading of the wafer 10 by the wafer handling mechanism 108. In particular, subsequent to rinsing of the semiconductor wafer 10, the detector 152 is operated to direct light onto the semiconductor wafer 10. This causes the abrasive particles within any residual chemical polishing slurry present on the wafer 10 to fluoresce light of a predetermined wavelength. Such fluoresced light is collected by the detector 152 in order for the intensity thereof to be determined. As described above, the intensity of the light fluoresced by the residual chemical polishing slurry is indicative of the amount of residual slurry which is present on the wafer 10. The detector 152 communicates output signals indicative of such an amount to the controller 82.

If the amount of chemical polishing slurry remaining on the semiconductor wafer is above a predetermined threshold, the controller 82 may cause the wafer 10 to be subjected to additional rinsing by the rinse mechanism 106. Alternatively, the controller 82 may operate the wafer handling mechanism 108 to move the wafer 10 to a separate work station at which the residual chemical polishing slurry may be removed.

As discussed above, it should be appreciated that detectors similar to the detector 152 may also be operated in order to detect presence of residual chemical slurry on the components associated with the polishing system 30. For example, a detector may be utilized to monitor residual chemical polishing slurry on the polishing pad 50. In such an arrangement, the detector may continuously monitor the buildup of residual slurry on the polishing pad 50, or may test the polishing pad 50 at predetermined time intervals such as the time period between the polishing of subsequent wafers 10.

Moreover, as also discussed above, a detector similar to the detector 152 may also be utilized to detect the percent solids level of the chemical polishing slurry in the slurry storage reservoir 74 during a polishing procedure. In such a manner, "closed loop" control of the percent solids level may be achieved by adjusting the solids content of the chemical polishing slurry based on output from the detector.

While the invention has been illustrated and described in detail in the drawings and foregoing description, such illustration and description is to be considered as exemplary and not restrictive in character, it being understood that only a preferred embodiment has been shown and described and that all changes and modifications that come within the spirit of the invention are desired to be protected.

There are a plurality of advantages of the present invention arising from the various features of the wafer fabrication process described herein. It will be noted that alternative embodiments of the wafer fabrication process of the present invention may not include all of the features described yet still benefit from at least some of the advantages of such features. Those of ordinary skill in the art may readily devise their own implementations of the wafer fabrication process that incorporate one or more of the features of the present invention and fall within the spirit and scope of the present invention as defined by the appended claims.

For example, it should be appreciated that the concepts of the present invention may be utilized in conjunction with numerous types of detectors. For example, hand-held detectors may be configured to detect presence of the chemical marker and hence residual chemical polishing slurry. Such hand-held detectors are particularly useful for allowing personnel to determine the locations of such residual slurry throughout a manufacturing facility.

What is claimed is:

1. A polishing system for polishing a semiconductor wafer, comprising:

a polishing station which is operable to remove material from said wafer, said polishing station having a polishing surface which contacts a first surface of said semiconductor wafer so as to remove said material therefrom;

a slurry distribution assembly for advancing a polishing slurry onto said polishing surface, said polishing slurry having a chemical marker present therein;

a rinse station which is operable to direct a flow of fluid onto said wafer subsequent to polishing by said polishing station; and a slurry detection station which is operable to detect presence of said chemical marker so as to determine presence of said polishing slurry on said wafer after said flow of fluid has been directed onto said wafer by said rinse station.

2. The polishing system of claim 1, wherein said slurry detection system includes a detector which is operable to (i) direct incident electromagnetic radiation onto said wafer, and (ii) detect a physical characteristic of resultant electromagnetic radiation which is produced in response to said incident electromagnetic radiation being directed onto said wafer.

3. The polishing system of claim 2, wherein said physical characteristic of said resultant electromagnetic radiation includes an intensity level of said resultant electromagnetic radiation.

* * * * *